United States Patent [19]

Michelsen et al.

[11] Patent Number: 5,056,722

[45] Date of Patent: Oct. 15, 1991

[54] TUBE MILL PARTITION

[75] Inventors: Ralph Michelsen, Eschede; Udo Schulze-Brockhausen, Everswinkel; Herbert Weit, Beckum, all of Fed. Rep. of Germany

[73] Assignee: Christian Pfeiffer Maschinenfabrik GmbH & Co. KG, Beckum, Fed. Rep. of Germany

[21] Appl. No.: 470,610

[22] Filed: Jan. 29, 1990

[30] Foreign Application Priority Data

Feb. 3, 1989 [DE] Fed. Rep. of Germany ..... 3903256

[51] Int. Cl.[5] ..... B02C 17/18

[52] U.S. Cl. ..... 241/181; 241/176; 241/72

[58] Field of Search ..... 241/171, 176, 179, 180, 241/181, 54, 70, 71, 72, 91

[56] References Cited

U.S. PATENT DOCUMENTS

| | | | |
|---|---|---|---|
| 2,595,509 | 5/1952 | Brown | 241/176 X |
| 3,949,949 | 4/1976 | Horning | 241/176 X |
| 4,032,075 | 6/1977 | Tyler, Sr. | 241/176 X |
| 4,664,322 | 5/1987 | Henne et al. | 241/176 |
| 4,697,747 | 10/1987 | Trelby | 241/176 X |

FOREIGN PATENT DOCUMENTS

| | | | |
|---|---|---|---|
| 1115799 | 9/1984 | U.S.S.R. | 241/176 |

*Primary Examiner*—Timothy V. Eley

*Attorney, Agent, or Firm*—Fleit, Jacobson, Cohn, Price, Holman & Stern

[57] ABSTRACT

The invention relates to a tube mill partition as the discharge or transfer wall. With a view to an improved air passage and a simple material flow regulation, in the case of this partition a substantially tubular central part is used, in that a rotary and/or wholly or segmentally axially displaceable adjusting ring regulates the material flow.

12 Claims, 2 Drawing Sheets

TUBE MILL PARTITION

BACKGROUND OF THE INVENTION

The invention relates to a tube mill partition with a material ball filing with a front slotted wall and a downstream rear wall, the slotted wall passing radially inwards into a central part with a central air passage opening and a lattice, whilst roughly radially oriented buckets are located between the slotted wall and the rear wall.

Such tube mill partitions are generally known, reference being made in exemplified manner to German Patent 24 47 262. It was standard practice with such known partitions, when used as a transfer or discharge wall in a tube mill, to provide in the central area of the partition a downstream, conically narrowing air passage opening. The truncated cone-shaped part of said air passage opening serves to transfer to the following tube mill chamber the grinding material raised by the lifting buckets as a result of the truncated cone-shaped guide plates.

Thus, this design of the air passage opening with a truncated cone-shaped cross-section has a damming back effect on the air blown and passed axially through the tube mill with a pressure and speed reducing effect, said energy loss having hitherto been accepted due to the transfer effect for the grinding material. However, in corresponding tube mills, as shown by German Patent 24 47 262, optionally intermediate walls have been inserted in the partition in order to regulate the material flow through a corresponding damming back effect.

Since for some time the grinding material supplied to the tube mills, such as e.g. cement clinker has undergone a primary crushing before the tube mill, said grinding or crushing material passes into the mill with a smaller particle size. Therefore ever greater significance is attached to the air flow present in the tube mill, so that every effort is made to keep the volume of the air flow as large as possible, without having to accept excessive energy losses through the pressure or flow reduction on passing through the tube mill.

SUMMARY OF THE INVENTION

Therefore the problem of the invention is to so design a tube mill partition, particularly as a transfer or discharge wall, that in the case of a relatively simple construction, there is an improved air flow with favourable material flow regulation and possibly an improved case of maintenance.

According to the invention this problem is solved in that the central part is essentially constructed as an axially parallel air passage opening with a free internal radius, which is approximately limited by the radius of a 22 to 36% material ball filling of the tube mill and that the central part has an adjusting ring adjacent to the rear wall adjustably arranged for freeing material passage openings in the vicinity of the rear wall.

From the constructional standpoint the invention makes use of two basic ideas. Firstly there is no truncated cone-shaped air passage opening and the latter is instead made in the form of a coaxial, roughly circular cylindrical opening, so that slowing down effects of the air blown into the tube mill are minimized in the vicinity of the air passage opening. This idea is also linked with the obviating of radial intermediate walls or rings for damming back the grinding or crushing material, in that the tubular passage opening is equipped with at lest one adjusting ring in the inner area of the partition adjacent to the rear wall. This adjusting ring is rotatable and/or is completely axially adjustably arranged in segmental form, the adjusting ring e.g. being axially displaceable to a stop on the inside of the rear wall. As the rear wall essentially has no slots, this prevents a transfer of the grinding material in the partition into the following chamber.

Through designing the rear wall in the vicinity of the air passage opening with an adjusting ring it is possible to e.g. predetermine the passage of minimum quantities, whilst through a displacement of the adjusting ring in the axial direction away from the partition an all-round or segmented annular clearance is opened making it possible to regulate the material flow or the transfer of grinding material into the next chamber.

The slots optionally present in the rear wall in the vicinity of the air passage opening make an additive contribution to the air passage. However, they primarily serve to set the minimum material flow quantity.

In order to improve this material flow regulation the basic principle is extended in such a way that at least in the rear part of the partition there is a stationary, tubular ring element. The latter can e.g. have openings in its circumferential wall, or such openings can additionally or alternatively only be provided in the marginal area with respect to the rear wall. Thus, the adjusting ring, which can be provided externally or internally completely or segmentally in axially displaceable and/or rotatable manner on the stationary ring element, can be so adjusted with coinciding openings that the openings in the adjusting ring and the stationary ring element coincide. In the case of the latter orientation of the openings, a maximum material flow is ensured. By a corresponding setting of the adjusting ring with respect to the ring element, it is possible to obtain a very precise regulation of the grinding material flow into the following chamber.

This idea of the coaxial, tubular air passage openings is extended with respect to the optimizing of the free air passage surface, in that it is possible to use as a basis a degree of filling in the chamber of the tube mill upstream of the partition of 20 to 36% and in particular approximately 25%. Such a filling level of approximately 25% material balls can now be used as a basis as a result of the normally preliminary crushing of the material before it reaches the tube mill. However, this means that the upstream internal diameter of the air passage opening of the central part of the partition can be made much larger. However, this diameter increase is not the only effect and instead the lattice hitherto provided in which the passage opening is designed with a lattice structure, e.g., as a wire netting, which has a free air passage surface of approximately 70 to 90% and in particular approximately 75%. This is most appropriately brought about by a wire netting, or use is made of a flat steel construction, e.g., of special or spring steel.

As a result of this lattice design the free-cross-section previously approximately 50% is increased to 70% and more. Moreover, when constructing the lattice from a special steel, when the balls of course grinding material strike against the lattice, they have a type of self-cleaning effect on the latter. Appropriately the lattice is inwardly displaced from the front of the partition and is in particular located roughly in the axial central region. It is then advantageous to position on either side of the lattice ball diverters for returning balls which have passed into the air passage space.

For maintenance reasons, particularly in the case of larger diameters of e.g. 1.90 m, the lattice is constructed with a circular inner part and an outer lattice ring. Thus, during maintenance it is only necessary to open one manhole in the tube mill to be able to pass from one chamber in to the next by merely removing the inner part of the lattice.

For the case the ball mill operator requires a filling level greater than approximately 25%, a corresponding ring can be fitted to the central part in the vicinity of the air passage opening, which reduces the diameter of the latter on the slotted wall side and on the rear wall side. Thus, even in the case of the partition specially designed for minimum filling levels, the tube mill can be rapidly reequipped for higher filling levels.

Thus, the basic idea of the invention provides for a substantially tubular, coaxial opening in the central area of the partition from the front slotted wall to and including the rear wall. The adjusting rings for regulating the material flow can be given a fixed setting for a specific material through-flow quantity. However, it is possible at any time to regulate the axial or rotary adjustment of said ring.

Thus, the invention provides a tube mill partition, in which in constructionally simple manner there is an optimum air passage and at the same tim a very accurately adjustable material flow.

BRIEF DESCRIPTION OF THE DRAWINGS

The invention is described in greater detail hereinafter, relative to non-limitative embodiments and the attached drawings, wherein show.

DESCRIPTION OF THE PREFERRED EMBODIMENT

Figure 1:
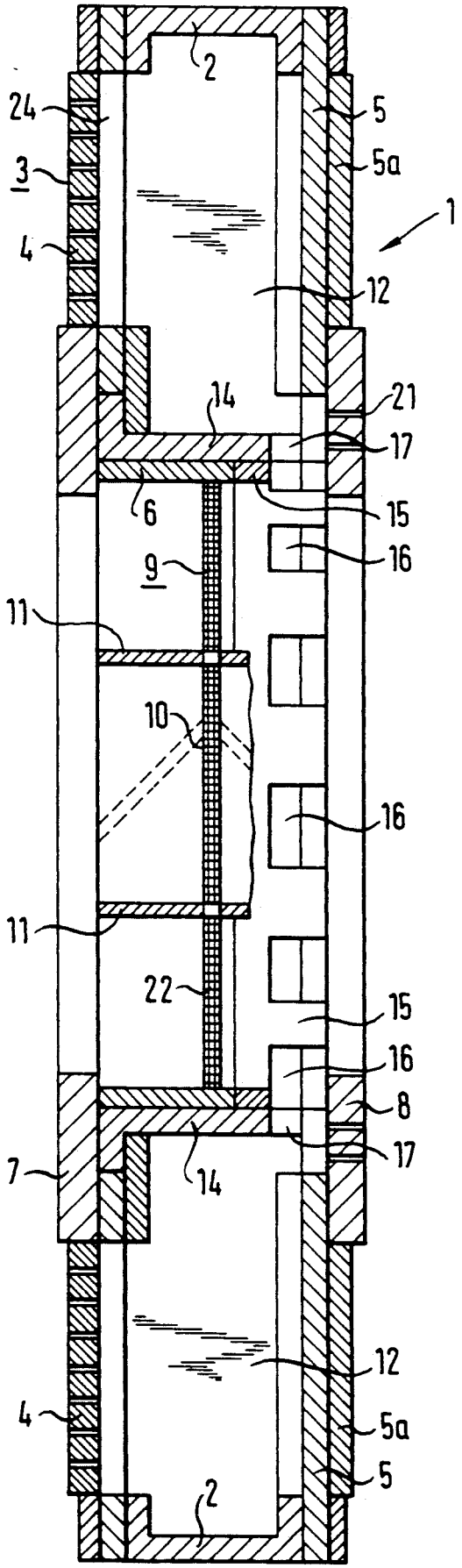
FIG. 1 a radial section through the basic construction of a tube mill partition as a transfer or discharge wall, the tube mill wall not being shown.

FIG. 1 diagrammatically shows in radial section a tube mill partition. 1. When the circular partition 1 is installed it bears with a U-shaped fixing ring 2 against the inner wall of the tube mill.

On the upstream, left-hand side of FIG. 1 is provided a slotted wall, which in segmented form has individual slotted plates 4. The latter are connected by means of sheet metal crosses 24 to the fixing ring 2. On the downstream right-hand side the partition 1 is terminated by a rear wall 5 with plates 5*a*, fixed thereto. Rear wall 5 in the present embodiment has an ring provided with slots 21, whose free internal diameter roughly corresponds to the free internal diameter of the central part 6 or in FIG. 1 the ring 7.

The essentially circular cylindrical, tubular central part 6 forms the central air passage opening, in whose central region is installed a lattice 9. The lattice is preferably made from special steel, and has a free passage surface of approximately 75 to 90% of its total area. In the present embodiment, said lattice 9 has a circular inner part 10, which can be easily dismantled and removed, whilst an outer lattice ring 22 is conventionally connected to the central part. On either side of the lattice 9 are provided ball diverters 11, which bring about an ejection of corresponding grinding balls into the particular chamber.

To the right of lattice 9 in the vicinity of the rear wall 5 or rear wall ring 9, the central part 6 is equipped with a segmented adjusting ring 15, which in the downstream direction is provided in its marginal region with approximately rectangular, segment-like openings 16. A stationary ring element 14 positively located on the adjusting ring 15 cooperates with the latter and in the marginal area with respect to the rear wall 5 also has substantially coinciding segment openings 17. Thus, by appropriate circumferential displacement, the adjusting ring 15 covers the underlying opening 17 of the stationary ring element 14, either entirely or partly, as a function of the angular displacement.

As the crushed material passes from the left-hand chamber via the corresponding slots in slotted wall 3 into the lower intermediate area between the slotted and rear walls, it is raised there by means of corresponding lifting buckets 12 and in accordance with the setting of the adjusting ring 15 via the corresponding opening 16 can flow out through the free internal diameter of the rear wall ring 8 into the right-hand chamber. A minimum material flow is possible through slots 21 when the adjusting ring 15 is completely closed.

Figure 2:
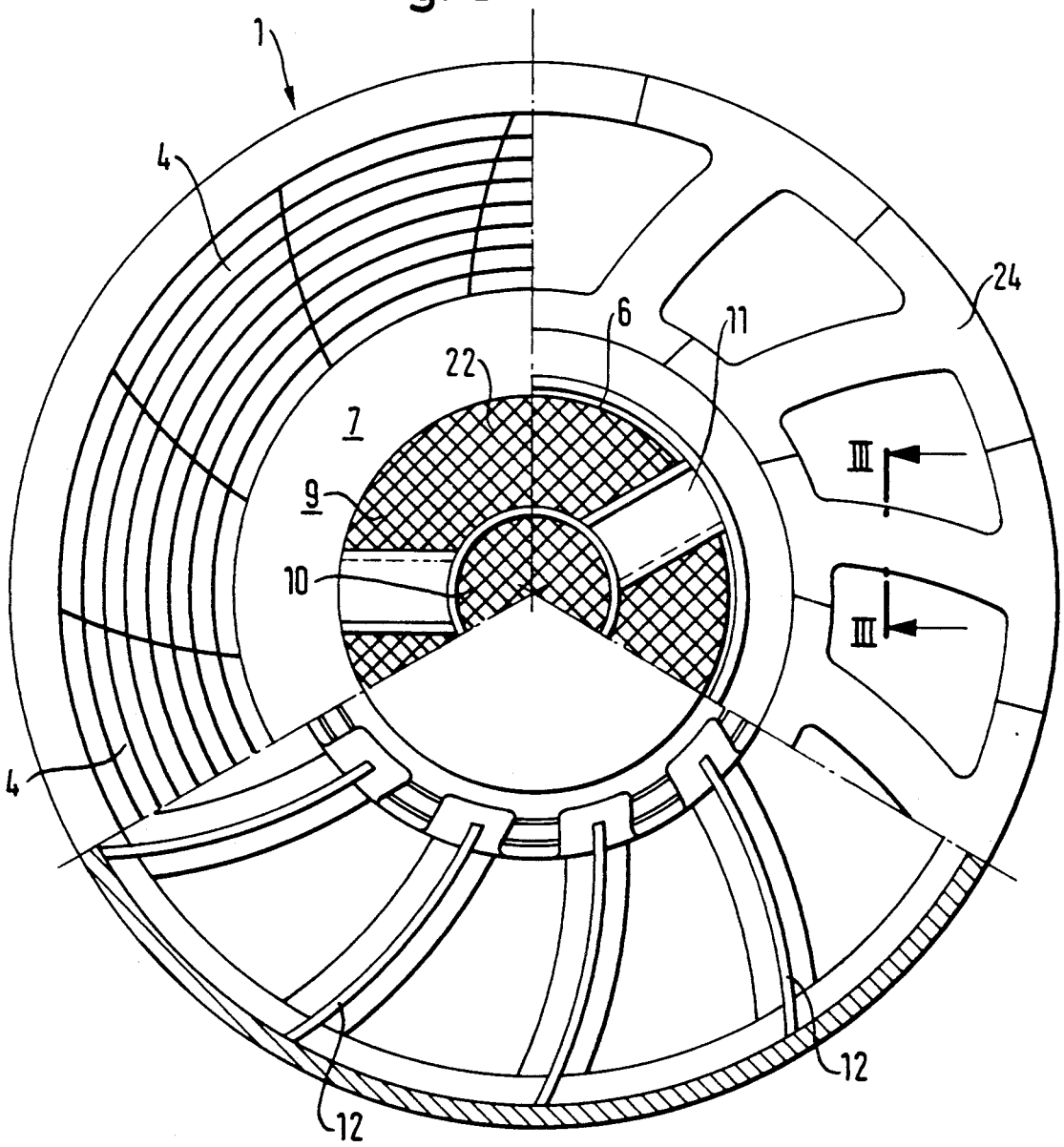
FIG. 2 an axial view of the partition according to FIG. 1 in the upper left-hand segment, whilst the two following segments to the right show radial sections in two different axial areas of the partition.

FIG. 2 shows three different views of the partition 1 according to FIG. 1. In the upper left-hand 120° segment, it is possible to see the segmental division of the slotted wall 3 into individual slotted plates 4, whose radial marginal area has a curved configuration. Radially inwards to said slotted plates 4 is connected a closed, subdivided ring 7, whose free internal diameter is adjusted to the filling level of the upstream ball mill chamber. Ring 7 is normally segmented and can therefore be replaced relatively easily.

Roughly in the centre of the axial extension of partition 1 lattice 9 with its circular inner part 10 and the outer lattice ring 22 is fixed to the central part 6. The ball diverters 11, whereof there are e.g. three on the upstream side of lattice 9, extend only up to the edge thereof so as to facilitate dismantling of the inner part 10.

In the upper right-hand segment of FIG. 2 are diagrammatically shown curved sheet metal crosses 24, to which are fixed the slotted plates 4. The lower segment of FIG. 2 indicates the curved lifting buckets 12.

Figure 3:
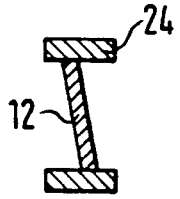
FIG. 3 a diagrammatic section along line III—III of FIG. 2 for the inclined position of a corresponding lifting bucket.

These lifting buckets 12 are, according to FIG. 3, radially curved and also slope in the axial direction, so as to be able to transfer in an optimum manner into the following chamber the grinding material passing into the partition.

The thus constructed partition 1 permits a much better air passage through it, so that energy losses are minimized. As a result of the segmentation of al the essential parts, maintenance work can be carried out relatively easily. The partition in the sense of a modular system can also be easily adapted to different filling levels of the tube mill and also ensures optimum ventilation. As a result of the provision of propellar-like ball diverters damage, particularly to the lattice in the air passage region is avoided. The adjusting ring permits a simple and also subsequent fitting of such a central part with easy adjustment and a large regulating range for the material flow.

What is claimed is:

1. A tube mill partition with a material ball filling with a front slotted wall and downstream rear wall, in which radially inwards the slotted wall passes into a central part with a central air passage opening with a lattice and radially oriented buckets are positioned between the slotted and rear walls, wherein the central part (6) is essentially constructed as an axially parallel air passage opening with an internal radius, which is about 22 to 36% of the mill radius inside of the material ball filling and wherein the central part (6) has an adjusting ring (15) adjacent to the rear wall (5) and which is displaceably arranged in the vicinity of the rear wall (5) for regulating a first material through-flow opening (16).

2. A tube mill partition according to claim 1, wherein the adjusting ring (15) is displaceable in rotary manner.

3. A tube mill partition according to claim 1, wherein the adjusting ring (15) is axially displaceable.

4. A tube mill partition according to claim 1, wherein the adjusting ring (15) is provided with said first opening (16), which can be adjusted in both rotary and axial manner with a second opening (17) of a stationary ring element (14) surrounding the adjusting ring.

5. A tube mill partition according to claim 4, wherein the first opening (16) is replicated around the edge of the adjusting ring (15).

6. A tube mill partition according to claim 4, wherein the second opening (17) is replicated around the edge of the ring element (14).

7. A tube mill partition according to claim 1, wherein lattice (9) is provided in axially inwardly displaced manner roughly in the central axial region of the central part (6).

8. A tube mill partition according to claim 1, wherein the lattice (9) has an air passage surface of approximately 70 to 90%.

9. A tube mill partition according to claim 1, wherein ball diverters (11) are provided upstream and downstream of the lattice (9).

10. A tube mill partition according to claim 1, wherein a rear wall ring (8) is provided, which has open slots (21) in the vicinity of the air passage opening.

11. A tube mill partition according to claim 1, wherein the height of the material ball filling can be increased on the slotted wall side by a ring (7) fixed radially to the central part (6).

12. A tube mill partition according to claim 1, wherein the adjusting ring (15) is segmented and is adjustably arranged in segments.

* * * * *